US009328468B2

(12) United States Patent
Emme et al.

(10) Patent No.: US 9,328,468 B2
(45) Date of Patent: May 3, 2016

(54) SELF-PROPELLED ROAD MILLING MACHINE WITH ADJUSTABLE WIDTH SCRAPER BLADE

(71) Applicant: Wirtgen GmbH, Windhagen (DE)

(72) Inventors: Hardy Emme, Dattenberg (DE); Andreas Salz, Neustadt/Wied (DE); Cyrus Barimani, Königswinter (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 14/382,572

(22) PCT Filed: Feb. 13, 2013

(86) PCT No.: PCT/EP2013/052895

§ 371 (c)(1),
(2) Date: Sep. 3, 2014

(87) PCT Pub. No.: WO2013/131726

PCT Pub. Date: Sep. 12, 2013

(65) Prior Publication Data

US 2015/0076892 A1 Mar. 19, 2015

Related U.S. Application Data

(63) Continuation-in-part of application No. 13/786,940, filed on Mar. 6, 2013.

(30) Foreign Application Priority Data

Mar. 8, 2012 (DE) ..... 10 2012 203 649

(51) Int. Cl.
*E01C 23/08* (2006.01)
*E01C 23/088* (2006.01)

(52) U.S. Cl.
CPC ..... *E01C 23/088* (2013.01)

(58) Field of Classification Search
CPC ..... E01C 23/088
See application file for complete search history.

(56) References Cited

U.S. PATENT DOCUMENTS 3,767,262 A 10/1973 Pentith
5,203,615 A 4/1993 Zanetis et al.

(Continued)

FOREIGN PATENT DOCUMENTS

DE 2420330 A1 11/1975
DE 2540047 A1 3/1977

(Continued)

OTHER PUBLICATIONS

European Search Report in corresponding European Patent Application EP 13 15 7759, mailed Jun. 19, 2013, 2 pp.

(Continued)

*Primary Examiner* — John Kreck
(74) *Attorney, Agent, or Firm* — Lucian Wayne Beavers; Patterson Intellectual Property Law, PC

(57) ABSTRACT

In a self-propelled road milling machine for processing road surfaces, with a machine frame supported by a height-adjustable chassis, with a milling drum mounted to rotate in a milling drum housing, with a milling drum drive for the milling drum, and with a height-adjustable scraper blade in the milling track of the milling drum, said scraper blade closing the milling drum housing towards the rear, it is provided for the following features to be achieved: that the scraper blade, laterally in the milling track of the milling drum, lies resiliently against the milling edge of the milling track, said milling edge extending orthogonal to the road surface.

7 Claims, 3 Drawing Sheets

(56) References Cited

U.S. PATENT DOCUMENTS

Figure 1:
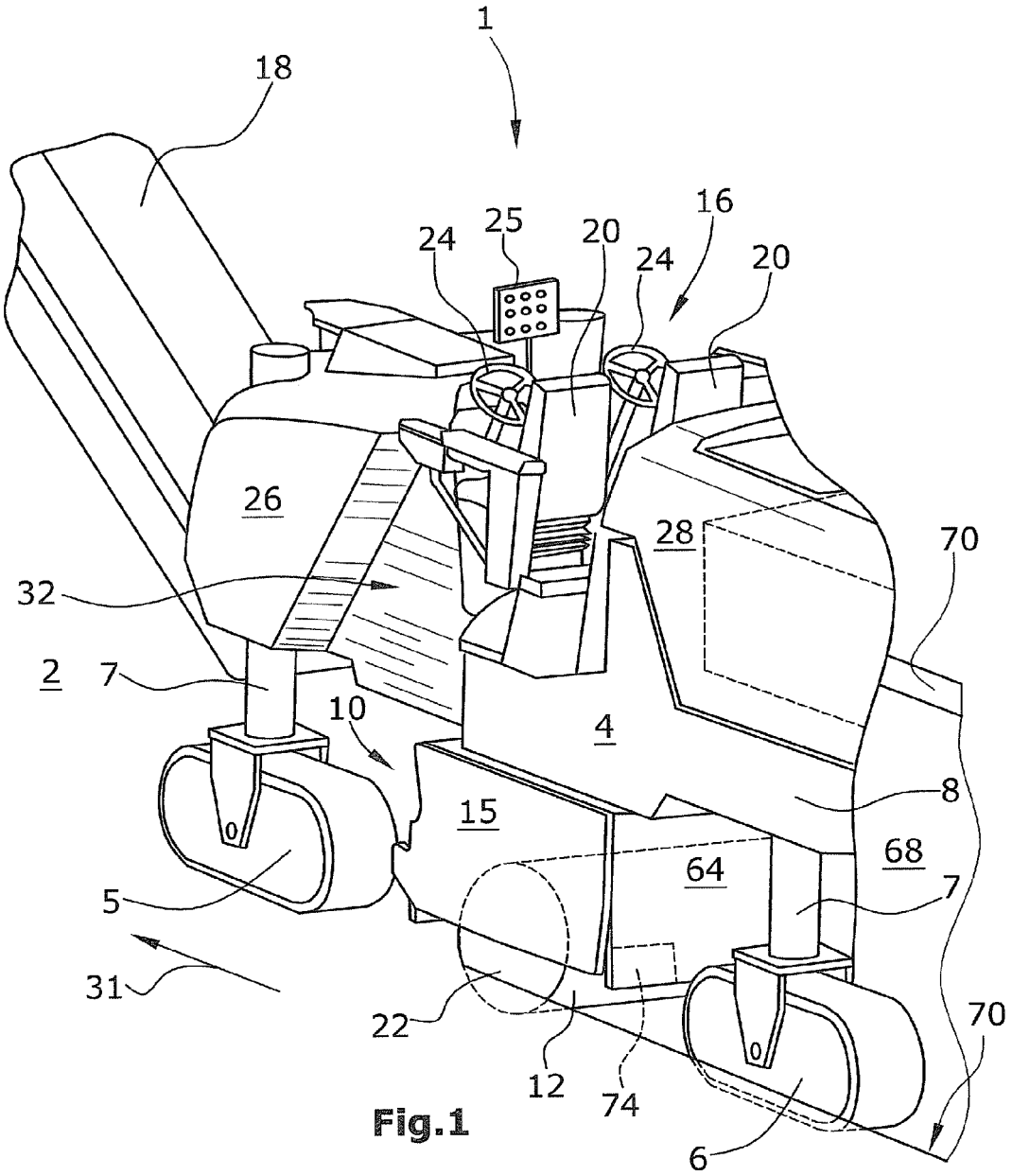

| | | | | |
|---|---|---|---|---|
| 5,474,397 | A | 12/1995 | Lyons | |
| 5,695,256 | A | 12/1997 | Kishimoto | |
| 6,296,318 | B1 | 10/2001 | Simons et al. | |
| 6,457,779 | B1 | 10/2002 | Busley et al. | |
| 6,923,508 | B2 | 8/2005 | Holl et al. | |
| 7,131,704 | B2 | 11/2006 | Murray et al. | |
| 7,370,916 | B2 | 5/2008 | Ley et al. | |
| 7,438,364 | B2 | 10/2008 | Boehme et al. | |
| 7,748,789 | B2 | 7/2010 | Freeburn | |
| 7,753,620 | B2 | 7/2010 | Kötting et al. | |
| 2004/0075330 | A1* | 4/2004 | Holl et al. | 299/39.2 |
| 2005/0123350 | A1* | 6/2005 | Ley et al. | 404/94 |
| 2008/0267706 | A1* | 10/2008 | Hall et al. | 404/90 |
| 2009/0010713 | A1 | 1/2009 | Kötting et al. | |
| 2013/0195554 | A1* | 8/2013 | Rukavina et al. | 404/90 |
| 2013/0234493 | A1 | 9/2013 | Emme et al. | |
| 2014/0361599 | A1* | 12/2014 | Losen et al. | 299/39.2 |

FOREIGN PATENT DOCUMENTS

| | | | | |
|---|---|---|---|---|
| DE | 8315139.7 | U1 | 2/1984 | |
| DE | 3409389 | A1 | 10/1985 | |
| DE | 3823480 | C1 * | 10/1989 | E01C 23/08 |
| DE | 19814053 | A1 | 10/1999 | |
| EP | 0685598 | A1 | 12/1995 | |
| EP | 0752501 | A1 | 1/1997 | |
| EP | 1408158 | A1 | 4/2004 | |
| EP | 1793041 | A1 | 6/2007 | |
| EP | 2011921 | A2 | 1/2009 | |
| GB | 2155525 | A | 9/1985 | |

OTHER PUBLICATIONS

International Search Report in corresponding International Patent Application PCT/EP2013/052895, mailed May 10, 2013, 3 pp.

International Written Opinion in corresponding International Patent Application PCT/EP2013/052895, mailed May 10, 2013, 7 pp.

Office Action of Sep. 11, 2015 in co-pending U.S. Appl. No. 13/786,940, 7 pp.

Office Action of May 23, 2014 in co-pending U.S. Appl. No. 13/786,940, 6 pp.

Office Action of Sep. 15, 2014 in co-pending U.S. Appl. No. 13/786,940, 8 pp.

Office Action of Jan. 26, 2015 in co-pending U.S. Appl. No. 13/786,940, 5 pp.

Office Action of Apr. 29, 2015 in co-pending U.S. Appl. No. 13/786,940, 8 pp.

* cited by examiner

SELF-PROPELLED ROAD MILLING MACHINE WITH ADJUSTABLE WIDTH SCRAPER BLADE

The invention relates to a self-propelled road milling machine, and a method for processing road surfaces.

Such road milling machines generally comprise a height-adjustable chassis comprised of front and rear tracked and/or wheeled ground-engaging units as seen in the direction of travel which form the front axle and the rear axle, respectively. In this arrangement, each axle may feature one or several ground-engaging units. The machine frame is supported by the chassis. At the machine frame, a milling drum housing is arranged which comprises a milling drum mounted to rotate in the milling drum housing. A transport conveyor device may be coupled at the milling drum housing by means of a conveyor shoe to transport away the milled material worked off and ejected by the milling drum.

Such road milling machine is known, for example, from EP 2 011 921 A.

One front end of the milling drum housing is nearly flush with an outer side of the machine frame, the so-called zero-clearance side, in order to enable milling as close along edges or obstacles as possible. The milling drum housing is not adjustable in height relative to the machine frame so that the entire machine weight can be transferred to the milling drum in order to enable high cutting forces and thus a high milling depth.

The problem with road milling machines, especially during milling operations that lead towards the inside relative to the zero-clearance side, is that the machine operator was unable to precisely follow a pre-determined bend line having a narrow bend radius. A solution to this problem is inferable from EP 2 011 921, said solution having enabled visual monitoring of the steering operation of a large milling machine which has allowed the manoeuvrability of a road milling machine to be improved.

It is the object of the invention to create a self-propelled road milling machine of the type first mentioned above which is usable in a more universal fashion and the manoeuvrability of which is improved.

The invention advantageously provides, in a road milling machine for the purpose of improving the manoeuvrability and for universal usability, for the scraper blade, laterally in the milling track of the milling drum, to lie resiliently against the milling edges of the milling track, said milling edges extending essentially orthogonal to the road surface.

As a result of the scraper blade being able to deflect laterally, narrow bend radii can be driven without the scraper blade getting jammed. A further advantage is offered in that, as a result of the scraper blade lying elastically against the milling edge of the milling track, the scraper blade is able to strip the milling track without any milled material remains.

In this arrangement, the rear end of the milling drum housing as seen in the direction of travel may terminate with a height-adjustable scraper blade, said scraper blade comprising, on both lateral ends, one movable blade element each which, on the bottom side, terminates essentially flush with the scraper blade and is height-adjustable together with the same, in which arrangement the blade elements are adjustable, against an initial tension, parallel to the scraper blade and the milling drum axis for dynamic adjustment of the scraper blade width during the milling operation.

Such scraper blade with lateral, movable side elements offers the advantage of the scraper width dynamically adjusting to the milling track. This is of advantage in particular when driving through narrow bends.

The initial tension is preferably generated hydraulically and may be intended to be adjustable also with regard to the degree of the initial tension force. Alternatively, the initial tension may be generated mechanically, for example, by means of a spring tension or with a gas spring.

In a method for processing road surfaces by milling the road surface with a milling drum of a road milling machine and stripping the milled material remaining in the milling track created by the milling drum by means of a scraper blade, it is intended, for dynamic adjustment of the width of the scraper blade to the milling track during the milling operation, for the scraper blade, laterally in the milling track, to lie resiliently against the milling edges of the milling track, said milling edges extending essentially orthogonal to the road surface.

This course of action offers the advantage that narrow bend radii can be driven without difficulty as the scraper blade cannot get jammed as a result of the dynamic adjustment of its position. The dynamic adjustment on both sides has the effect that the scraper blade can be guided in the milling track in a laterally sealing fashion and that no damage or no increased wear and tear can be caused to the scraper blade in particular when driving through narrow bends.

In the following, one embodiment of the invention is explained in more detail with reference to the drawings.

Figure 2:
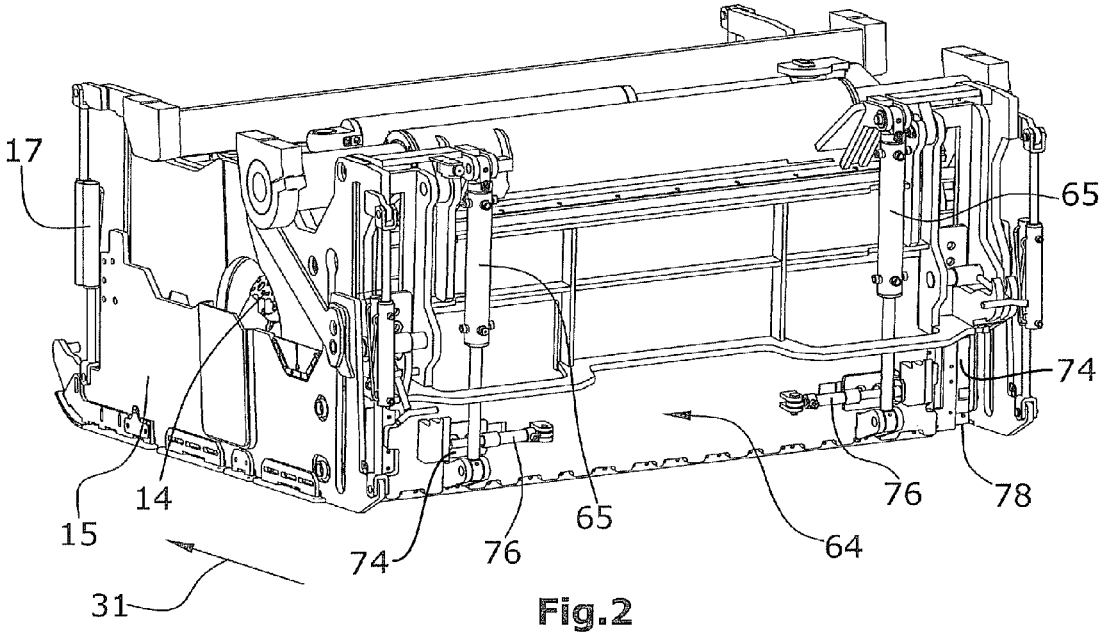

The following is shown:

FIG. 1 a schematic partial view of the self-propelled road milling machine,

FIG. 2 a rear view of the milling drum housing including scraper blade, and

Figure 3:
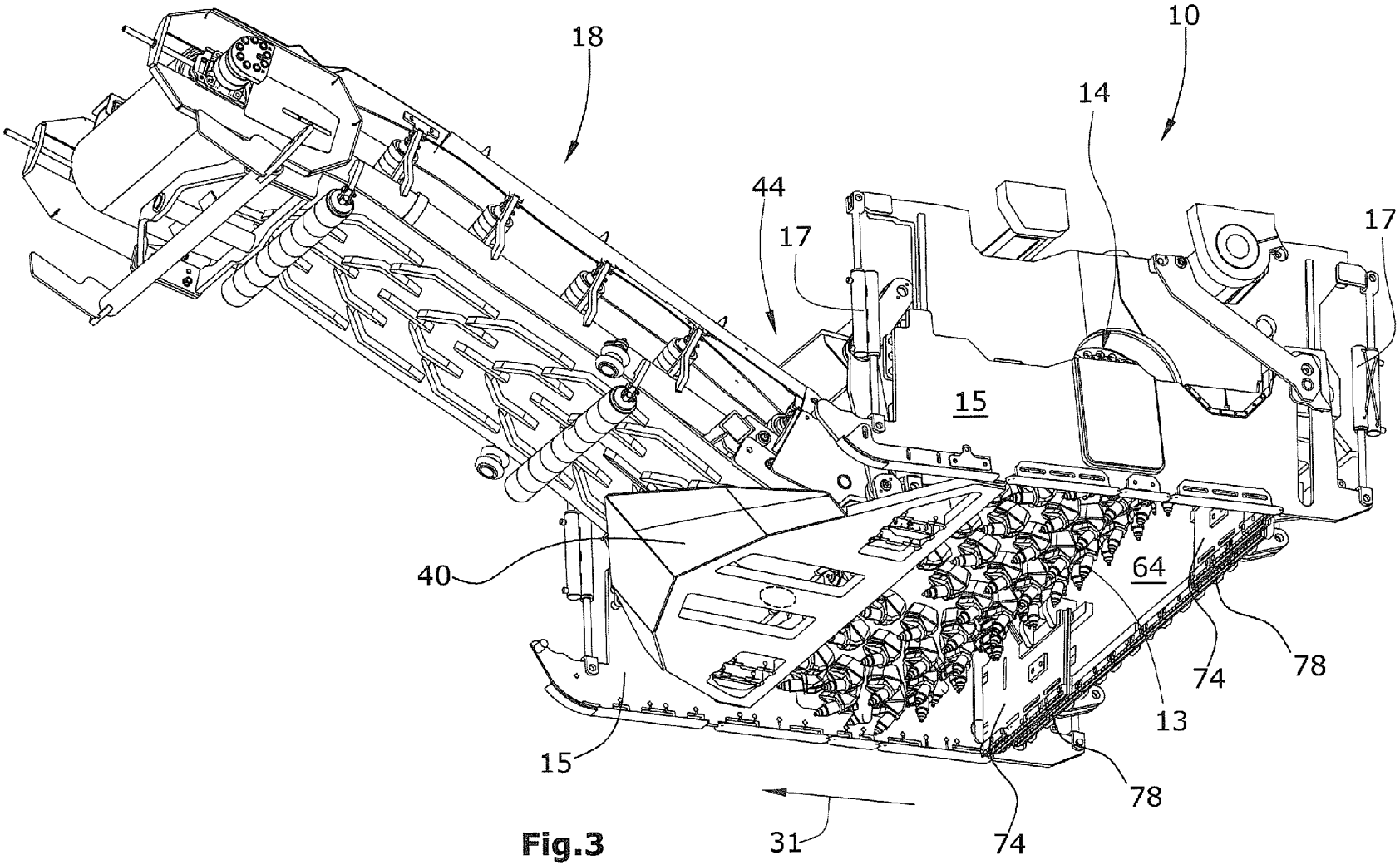

FIG. 3 a perspective view of the combined milling drum housing and coupled transport conveyor device seen from below.

FIG. 1 shows a road milling machine 1 with a machine frame 8 and a chassis 4 with front and rear ground-engaging units 5, 6 as seen in the direction of travel 31. The ground-engaging units 5, 6 form a steerable front axle and a steerable rear axle. The chassis 4 is connected to the machine frame 8 via lifting columns 7 that enable adjustment of the distance of the machine frame 8 from a road surface 2. Each axle of the chassis comprises no less than one tracked ground-engaging unit 5, 6 or one wheeled ground-engaging unit.

At the forward end of the road construction machine 1 as seen in the direction of travel, a transport conveyor device 18 capable of pivoting in height and slewing in lateral direction may be arranged for transporting away the milled-off milled material. Alternatively, a transport device may be arranged at the rear end of the road construction machine at the scraper blade.

The front and the rear ground-engaging units 5, 6 of the chassis 4 may be comprised of tracked ground-engaging units or wheels.

A milling drum 12 is arranged between the ground-engaging units 5, 6, said milling drum being supported, with its milling drum axis, in a milling drum housing 10 and being driven via a milling drum drive 14.

With its one front end 22, the milling drum 12 extends up to the outer side 26, 28 of the machine frame 8 depicted in FIG. 1 as the zero-clearance side. On the zero-clearance side, the respective front end 22 of the milling drum is arranged in very close proximity to the outer side of the road milling machine, thus enabling milling very close along road edges or obstacles.

One height-adjustable side blade 15 each is arranged at the front ends 22 of the milling drum 12 and next to the milling drum housing 10, said side blade 15 functioning as an edge protection.

The milling drum 12 may be arranged centrally between the front ground-engaging unit 5 and the rear ground-engaging unit 6 as seen in the direction of travel 31. Alternatively, the milling drum may, for example, be arranged between the rear ground-engaging units 6.

The milling drum 12 is provided with tools 13. The milling drum 12 rotates in clockwise direction as seen in the view from the left side of FIG. 1.

The milling drum 12 may also be composed of several parts or may be comprised, for example, of no less than one drum tube pushed onto a basic body. Similarly, the milling drum may also be composed of several segments.

Above the milling drum 12, an operator's platform 16 is located which may feature two seats 20 with two steering devices 24 intended for milling flush either along the left side or along the right side of a road. It is understood that an operator's platform movable transverse to the direction of travel with one seat and accompanying steering device 24 may also be used which is movable to the left or right side of the road milling machine 1 as needed.

The outer side 26, 28 may feature a cut-out 32 in front of the operator's platform 16. Said cut-out 32 enables monitoring of the front ground-engaging unit 5, and thus monitoring of the current steering angle.

In FIG. 1, the milling drum housing 10 is shown with a raised scraper blade 64, with the side blade 15 being also raised to show the position of the milling drum 12. The side blade 15 is attached, on both sides, to the milling drum housing 10 via a dual arrangement of piston-cylinder units 17, said dual arrangement enabling a particularly large stroke of the piston-cylinder units 17.

In FIG. 3, a conveyor shoe 40 is arranged at the front side of the milling drum housing 10, said conveyor shoe having the function of accommodating the lower end 44 of the transport conveyor device 18.

The tools 13 of the milling drum 12 are arranged helically in circumferential direction, in which arrangement the milling drum 12 exhibits helices of tools 13 running in opposite directions which transport the milled-off material to the ejection opening and convey the same from the ejection opening onto the transport conveyor device 18.

FIG. 2 shows a rearward perspective view of the milling drum housing 10 with a scraper blade 64 being arranged at the same which is adjustable in height by means of piston-cylinder units 65. The scraper blade 64 may additionally be pivoted upwards in the event that the tools 13 on the milling drum 12 must be accessible.

The scraper blade 64 exhibits, on its side facing the milling drum 12 and at its lateral outer edges, one movable blade element 74 each which can be pressed against the milling edge 70 (FIG. 1) extending orthogonal to the road surface 2 in the milling track 68 by means of a resilient pre-tensioning device 76.

The lower edge 78 of the laterally movable blade element 74 terminates flush with the lower edge of the scraper blade 64. The blade elements 74 are adjustable in height together with the scraper blade 64. The resilient pre-tensioning devices 76 may generate the initial tension in different ways. In the embodiment of FIG. 2, the pre-tensioning devices 76 are depicted as piston-cylinder elements which can be pre-tensioned hydraulically.

The invention claimed is:

1. A self-propelled road milling machine for processing road surfaces, comprising:

a machine frame including a lateral outer side;

a height adjustable chassis configured to support the machine frame from a road surface;

a milling drum housing attached to the machine frame, the milling drum housing including a lateral end terminating substantially flush with the lateral outer side of the machine frame to define a zero-clearance side in order to enable milling as close along edges or obstacles as possible;

a milling drum mounted in the milling drum housing to rotate about a milling drum axis;

a milling drum drive connected to the milling drum to drive the milling drum such that the milling drum mills a milling track in the road surface, the milling track having a milling edge; and wherein the milling drum housing includes a height adjustable scraper blade closing a rear of the milling drum housing and configured to engage the milling track, the scraper blade including:

a main scraper blade body having a lower edge and having first and second lateral ends;

a first movable blade element laterally movable relative to the main scraper blade body, the first movable blade element including a blade element lower edge essentially flush with the lower edge of the main scraper blade body, and the first movable blade element being height adjustable together with the main scraper blade body;

a first piston-cylinder element connected to the first movable blade element and configured to provide a hydraulic biasing force to resiliently bias the first laterally movable blade element laterally outward relative to the first lateral end of the main scraper blade body in a direction parallel to the milling drum axis for dynamic adjustment of a width of the scraper blade during milling operation; and wherein the first piston-cylinder element is adjustable to adjust the hydraulic biasing force against the first movable blade element.

2. The machine of claim 1, wherein the scraper blade further includes:

a second movable blade element laterally movable relative to the main scraper blade body; and a second piston-cylinder element connected to the second movable blade element and configured to provide a hydraulic biasing force to resiliently bias the second movable blade element laterally outward relative to the second lateral end of the main scraper blade body.

3. The machine of claim 1, further comprising:

a transport conveyor arranged to transport milled material milled off by the milling drum from the milling drum housing forward to a front of the machine in a milling direction.

4. The machine of claim 1, wherein:

the chassis includes a front chassis axle and a rear chassis axle, and the milling drum housing is located between the front and rear chassis axles.

5. The machine of claim 1, wherein:

the scraper blade is pivotable upwards.

6. The machine of claim 1, wherein:

the milling drum housing is movable transversely relative to the machine frame.

7. A method of processing road surfaces, the method comprising:

(a) milling a road surface with a milling drum of a road milling machine to create a milling track having at least one milling edge;

(b) stripping milled material remaining in the milling track with a scraper blade of the road milling machine;

(c) dynamically adjusting a width of the scraper blade during step (b) by hydraulically biasing at least one laterally movable blade element of the scraper blade parallel to a milling drum axis and a main scraper blade body and thereby providing a laterally directed hydraulic biasing force such that the movable blade element lies resiliently against the at least one milling edge; and (d) adjusting an initial hydraulic biasing force applied to the at least one laterally movable blade element in step (c).

* * * * *